US005632134A

United States Patent [19]

Noel et al.

[11] Patent Number: 5,632,134

[45] Date of Patent: May 27, 1997

[54] METHOD OF PREPARING A PACKAGE HAVING A MULTIPLE-FILM LID

[75] Inventors: David C. Noel, Greer; Henry W. Stockley, III, Spartanburg, both of S.C.

[73] Assignee: W. R. Grace & Co.-Conn., Duncan, S.C.

[21] Appl. No.: 526,000

[22] Filed: Sep. 8, 1995

[51] Int. Cl.[6] ..... B65B 31/00

[52] U.S. Cl. ..... 53/433; 53/449

[58] Field of Search ..... 53/432, 433, 449, 53/462, 467, 511, 559

[56] References Cited

U.S. PATENT DOCUMENTS

| | | | |
|---|---|---|---|
| 3,481,100 | 12/1969 | Bergstrom | 53/453 |
| 3,674,626 | 7/1972 | Mergy | 53/453 |
| 3,750,362 | 8/1973 | Kishpaugh et al. | 53/453 |
| 3,783,089 | 1/1974 | Hurst et al. | 161/166 |
| 4,055,672 | 10/1977 | Hirsch et al. | 426/127 |
| 4,058,953 | 11/1977 | Sanborn, Jr. et al. | 53/22 |
| 4,085,565 | 4/1978 | Mahaffy et al. | 53/112 |
| 4,240,241 | 12/1980 | Sanborn, Jr. | 53/453 |
| 4,437,293 | 3/1984 | Sanborn, Jr. | 53/453 |
| 4,594,835 | 6/1986 | Gray | 53/453 |
| 5,087,462 | 2/1992 | Bekele et al. | 53/433 |
| 5,103,618 | 4/1992 | Garwood | 53/433 |
| 5,226,531 | 7/1993 | Garwood | 53/433 |
| 5,323,590 | 6/1994 | Garwood | 53/433 |
| 5,344,405 | 9/1994 | Gorlich | 426/124 |
| 5,348,752 | 9/1994 | Gorlich | 53/449 |

FOREIGN PATENT DOCUMENTS

| | | | |
|---|---|---|---|
| 2271545 | 4/1994 | United Kingdom | 53/453 |

*Primary Examiner*—John Sipos
*Assistant Examiner*—Ed Tol
*Attorney, Agent, or Firm*—Thomas C. Lagaly

[57] ABSTRACT

A method of preparing a package having a product enclosed between a support member and a multiple-film lid, comprising the steps of providing a support member supporting a product; providing a multiple-film lid over the product and the support member, the multiple-film lid having a first film for enclosing the product on the support member when sealed thereto and a second film over the first film, the first film and the second film defining a first space therebetween and the first film and the support member defining a second space therebetween; evacuating the first and second spaces; and sealing the multiple-film lid to the support member so as to form a sealed package.

19 Claims, 2 Drawing Sheets

METHOD OF PREPARING A PACKAGE HAVING A MULTIPLE-FILM LID

BACKGROUND OF THE INVENTION

The invention relates generally to a method of preparing a package, and specifically to a method of preparing a package having a multiple-film lid. The multiple-film lid has an impermeable film which may be peeled so as to expose a permeable film.

Present methods for packaging products such as fresh red meats and the like involve evacuating and gas flushing the interior spaces of the package so as to enhance the shelf-life and appearance of the product contained in the package.

A problem encountered particularly with respect to packaging of fresh red meats is that removal of oxygen in an evacuated package causes the meat to take on a purplish color which is not desirable to consumers. Responsive to this problem, packages have been developed which include an oxygen-permeable or non-barrier film enclosing the product, and a peelable oxygen barrier or impermeable film disposed over the permeable film. Generally as used herein, the term "impermeable" connotes gas impermeability as further described and defined below. This type of package provides the advantage that the interior space of the package can be evacuated and back-flushed with low oxygen gas or gases for shipping and long-term storage and, when the product is to be displayed for the consumer, the impermeable film is removed to allow atmospheric oxygen to permeate the permeable film and thereby cause the fresh red meat product to "bloom" or take on a bright red color which the consumer associates with freshness.

A problem encountered with the preparation of packages having permeable and impermeable films is that residual air or gas containing oxygen is frequently trapped in the space between the films. This occurs because it is difficult to pull a vacuum between the permeable and impermeable films without disrupting the permeable lid, leading to trapped residual gas or air which can allow oxygen to permeate the permeable film, expose the product prematurely to oxygen, and damage the product.

One approach designed to avoid the problem of trapped residual gas is to apply the permeable film and impermeable film layer at separate sealing/evacuation stations. Although this approach may reduce the problem of trapped residual gas and air, a disadvantage remains in that two sealing/evacuation stations must now be used. This can create a number of problems. Second stage evacuation can damage or distend the permeable film. Also, the two-step operation can decrease manufacturing efficiency. Moreover, the extra stage requires increased space for the packaging apparatus.

Accordingly, there is a need in the art for an improved method of preparing a package having a multiple-film lid, including a permeable film and an impermeable film, wherein both films are sealed at a single sealing station. Such a method would desirably provide evacuation between the permeable film and the impermeable film, thereby avoiding the aforementioned problems associated with trapped air between the films.

SUMMARY OF THE INVENTION

In accordance with one aspect of the present invention, a method of preparing a package having a product enclosed between a support member and a multiple-film lid is provided. The method generally comprises the steps of:

providing a support member supporting a product;

providing a multiple-film lidding material and positioning said multiple-film lidding material over the product and support member, the multiple-film lidding material having a first film for enclosing the product on the support member when sealed thereto and a second film over the first film, the first film and the second film defining a first space therebetween and the first film and the support member defining a second space therebetween;

evacuating the first and second spaces; and sealing the multiple-film lid to the support member.

Preferably, the first film comprises a permeable film and the second film comprises an impermeable film.

In accordance with another aspect of the invention, a method of preparing a package having a product enclosed between a support member and a multiple-film lid is provided which comprises the steps of:

providing a support member supporting a product;

providing a multiple-film lid and positioning the multiple-film lid over the product and support member as described above;

providing a fluid passage in at least one of the first film and the second film;

providing an evacuating and sealing station having a vacuum means for providing a vacuum within the station and having a sealing means for sealing the multiple-film lid to the support member, the sealing means being positioned within the vacuum means, wherein the vacuum means defines a vacuum perimeter and wherein the sealing means defines a sealing perimeter within the vacuum perimeter;

placing the support member supporting the product with the multiple-film lid positioned thereover in the evacuating and sealing station such that the fluid passage is positioned inside the vacuum perimeter and outside the sealing perimeter;

evacuating the first and second spaces with the vacuum means; and sealing the multiple-film lid to the support member.

The fluid passage may be provided by forming at least one slit in the first film and positioning the slit(s) inside the vacuum perimeter and outside the sealing perimeter. Alternatively, the fluid passage may be provided by cutting the first film so as to provide at least a portion of at least one edge of the first film which is positioned between the vacuum perimeter and the sealing perimeter.

BRIEF DESCRIPTION OF THE DRAWINGS

A detailed description of preferred embodiments of the invention follows, with reference to the accompanying drawings, wherein.

DETAILED DESCRIPTION OF PREFERRED EMBODIMENTS

The invention relates to a method of preparing a package having a product enclosed between a support member and a multiple-film lid. Specifically, the invention relates to such a method wherein the multiple-film lid includes a permeable film and an impermeable film which are sealed to a support member for the product at a single sealing station while advantageously providing evacuation, and optionally gas flushing, of a first space between the films and a second space between the films and support member.

Figure 1:
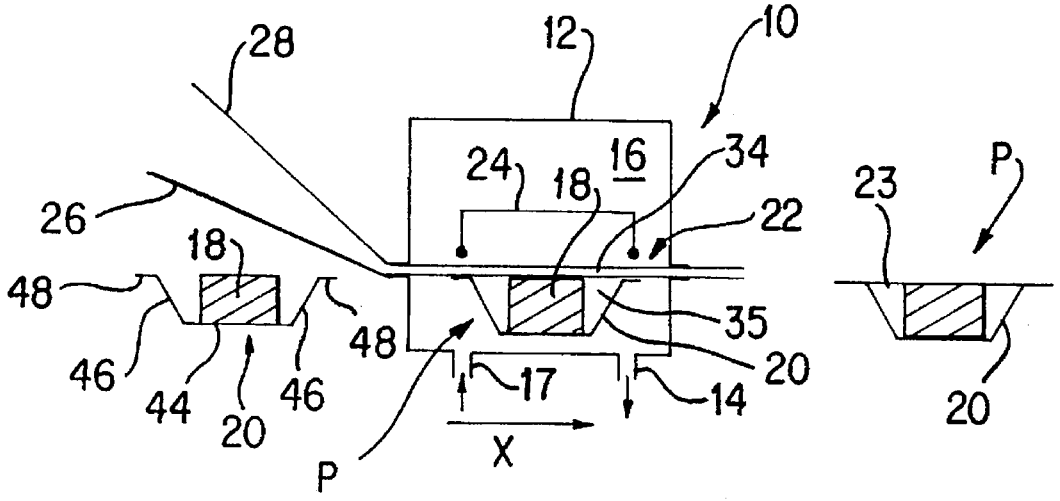
FIG. 1 is a side schematic view of a method for preparing a package in accordance with the present invention.

Referring now to FIG. 1, a method of preparing a package in accordance with the present invention will be described. FIG. 1 illustrates an evacuating and sealing station 10 having a vacuum chamber 12, evacuating ports 14 (only one shown), and means for drawing a vacuum (not illustrated) for evacuating the space 16 defined within vacuum chamber 12 when the films and support member holding the product are positioned therein. The term "vacuum" as used herein includes partial vacuums as is well understood in the art. The term "evacuating" as used herein refers to the removal of any desired mount of gas (e.g., air) form vacuum chamber 12, e.g., an mount ranging from 1% to 99.99% by volume. Typically, an mount of gas ranging from about 99.5% to about 99.9% by volume will be removed from vacuum chamber 12 during the evacuating process.

Means for introducing a gas such as gas flush tube 17 is optionally provided for the operational gas flushing step as is further described below. As shown in FIG. 1, products 18, preferably fresh red meat products, are first positioned on support members 20 which are then positioned within sealing station 10. A multiple-film lidding material 22 is positioned over product 18 and support member 20.

Evacuating and sealing station 10 preferably includes one or more sealing members 24, preferably heat-seal members, positioned within vacuum chamber 12 for sealing a portion of multiple-film lidding material 22 to support member 20. The sealed portion of multiple-film lidding material 22 is then separated from the remainder of the lidding material, thereby forming a multiple-film lid 23 on support member 20. When a plurality of sealing members 24 are provided, a plurality of packages P may be prepared with each cycle at station 10.

Multiple-film lidding material 22 preferably includes a permeable film 26 and an impermeable film 28 which may be provided to sealing station 10 from separate rolls as shown schematically in FIG. 1. Alternatively, both films (26 and 28) may be provided from a single roll. In conventional processes, air or residual gas becomes trapped between films 26 and 28, causing problems with respect to effectiveness of the package and capability to maintain the desired shelf-life for the product. According to the invention, this problem is minimized or avoided as discussed below.

In accordance with the method of the present invention, support member 20 supporting product 18 is positioned within sealing station 10 having multiple-film lidding material 22 positioned over product 18 on support member 20. Vacuum chamber 12 is closed and activated so as to evacuate chamber 12. In so doing, space 35 between permeable film 26 and support member 20 is also evacuated. Sealing member 24 is then activated so as to seal, preferably by heat seal, multiple-film lidding material 22 to support member 20. The sealed portion of multiple-film lidding material 22 is then separated from the remainder of the lidding material, e.g., by cutting the sealed portion of the lidding material along the outer perimeter of support member 20 with a knife, to thereby form multiple-film lid 23 on support member 20.

Impermeable film 28 and permeable film 26 may have a space 34 defined therebetween when positioned over support member 20 holding product 18 when positioned in chamber 12 prior to evacuation. Space 34, however, can contain air or residual gases which is undesirable because such trapped air or gas can cause a decrease in the shelf-life of product 18 by permeating through permeable film 26 and thus prematurely exposing product 18 to oxygen. According to the invention, trapping of residual gasses is avoided.

If desired, a flushing gas can be introduced into spaces 34 and 35 via gas flush tube 17 and a gas supply means (not illustrated) to provide a gas flushing of the package P prior to sealing so as to provide package P with a controlled gas atmosphere.

Figure 2:
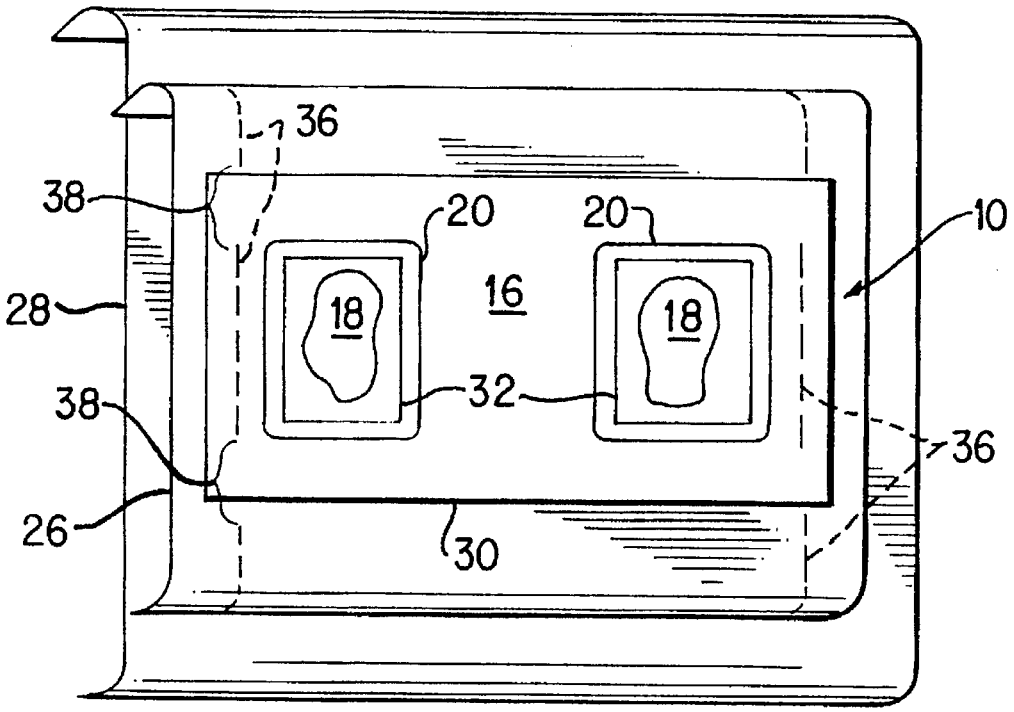
FIG. 2 is a top schematic view of an evacuating and sealing step in accordance with the method of the present invention.
Figure 3:
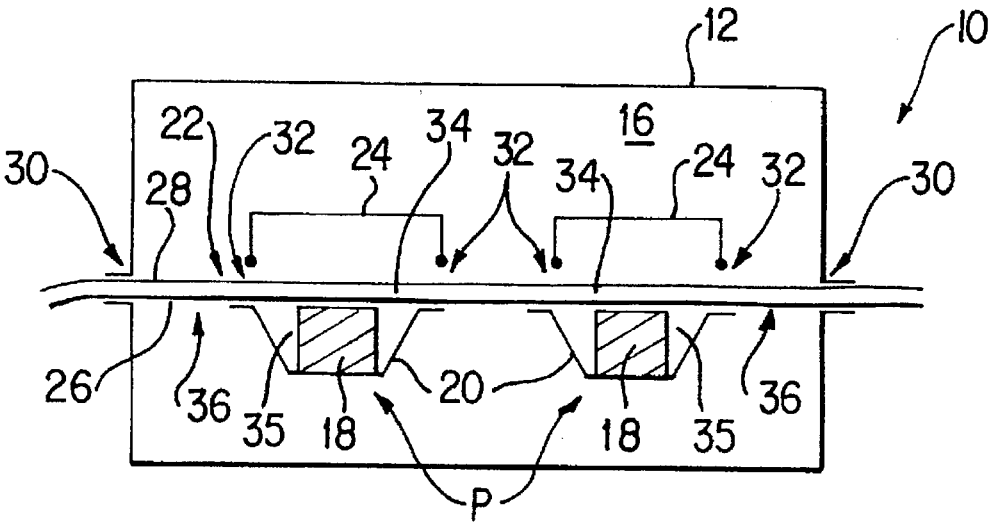
FIG. 3 is a sectional and schematic side view of the evacuating and sealing step of FIG. 2.

Referring now to FIGS. 2 and 3, the method of the present invention will be further illustrated. FIG. 2 is a top schematic view of an evacuating and sealing station 10 in use in accordance with the method of the present invention. Vacuum chamber 12 of station 10 defines a vacuum perimeter 30 as shown. Sealing members 24 of station 10 (shown in FIG. 3 but not in FIG. 2) define sealing perimeters 32 which are positioned within vacuum perimeter 30 as shown. Two sealing members 24, defining two sealing perimeters 32, are illustrated in FIGS. 2 and 3.

Permeable film 26 is preferably provided with a fluid passage to allow fluid communication of gases to and from space 34 (see FIG. 3), defined between permeable film 26 and impermeable film 28, thereby allowing evacuation and/or gas flushing of space 34 as desired in accordance with the method of the present invention. Alternatively, a fluid passage may be provided in impermeable film 28. It should be noted that the size of space 34 as shown in the drawings is exaggerated for the sake of clarity. Space 34 between films 26 and 28 would conventionally trap any air or residual gas contained therein as set forth above. According to the invention, however, communication to space 34 is provided so as to advantageously provide evacuation and gas flushing of space 34 as well as space 35 of packages P.

The fluid passage in accordance with one embodiment of the invention is shown in FIG. 2. In this embodiment, the fluid passage is provided as a series of holes or slits 36 which may be formed along permeable film 26 for positioning within sealing station 10 such that slits 36 fall within vacuum perimeter 30 and outside of sealing perimeters 32. Slits 36 may be formed in film 26 using conventional equipment as is well known in the art, for example, using mechanical or thermal means such as a laser or ultrasonic device. As an alternative, slits 36 may instead be formed in impermeable film 28.

Slits 36 may have any desired shape, configuration, or pattern. For example, slits 36 may be straight and in a substantially straight line as shown in FIG. 2. Alternatively, the slits may be configured in a diagonal, criss-cross, or zigzag pattern. The slits may also be curved or oval in shape. Other shapes, configurations, and/or patterns are also possible.

In accordance with the method of the present invention, the described positioning of slits 36 allows communication of gases between evacuating ports 14 or gas flush tube 17 and space 34 between films 26 and 28 to evacuate and/or introduce a gas into space 34. Further, positioning of slits 36 outside of sealing perimeter 32 allows slits 36 to be trimmed away along with excess permeable film 26 and barrier film 28 so as to provide a finished product P which is familiar in appearance to the consumer and which maintains the desired package characteristics and functions.

Still referring to FIG. 2, slits 36 may advantageously be positioned or spaced on film 26 so as to provide spacings 38 which in accordance with the invention preferably coincide or align with vacuum perimeter 30 whereby slits 36 do not interfere with the proper operation of vacuum chamber 12 and avoid loss of vacuum.

As shown by arrow X in FIG. 1, the method of the present invention is preferably a continuous method whereby multiple-film lidding material 22, support members 20 and products 18 are fed to evacuating and sealing station 10. Of course, the teachings of the present invention are equally applicable with reference to non-continuous processes.

With reference to the foregoing, it should be readily apparent that the method of the present invention allows a multiple-film lidding material 22 to be sealed to a support member 20 at a single sealing station 10 while providing for evacuation and gas flushing of the space 34 between films 26 and 28 of multiple-film lidding material 22.

Figure 4:
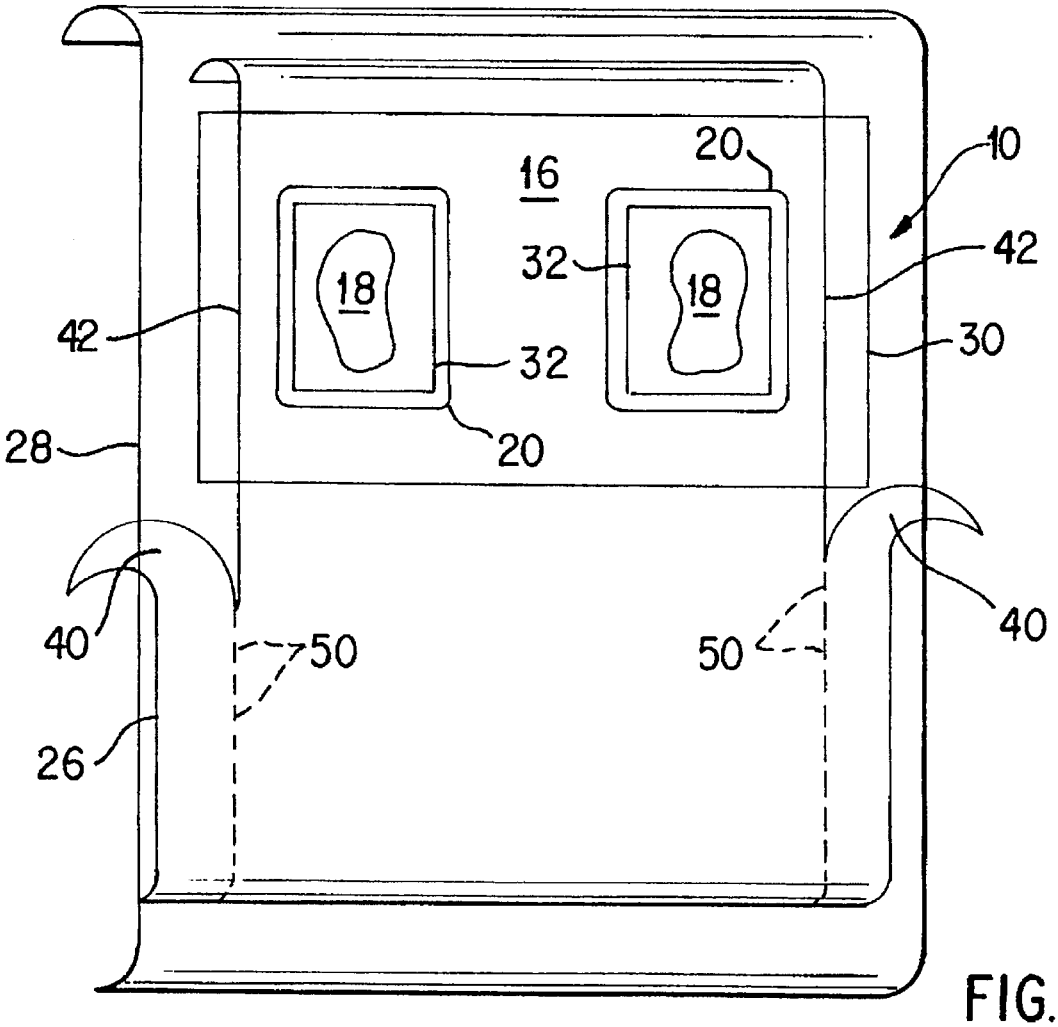
FIG. 4 is a top schematic view of an alternative embodiment of an evacuating and sealing step in accordance with the present invention.

Referring now to FIG. 4, an alternative embodiment of the present invention will be described. In accordance with this embodiment of the invention, evacuating and sealing station 10 is essentially unchanged as is the positioning of product 18 on support member 20 within vacuum chamber 12.

In accordance with the alternative embodiment of FIG. 4, the fluid passage in permeable film 26 is provided by cutting away or otherwise removing a portion 40 of permeable film 26 so as to provide an edge 42 of permeable film 26 which falls within vacuum perimeter 30 and outside sealing perimeters 32. In this embodiment, fluid communication of gases including evacuation and gas flushing of space 34 is provided around edge 42. As an alternative, such fluid passage could instead be formed in impermeable film 28.

FIG. 4 schematically illustrates the continuous removal of portion 40 so as to provide permeable film 26 with edge 42 positioned between vacuum perimeter 30 and sealing perimeter 32 along substantially the entire length thereof. According to the invention, film 26 may be provided with perforations 50 as shown to facilitate removal of portion 40.

It should be noted that portion 40 of permeable film 26 need not be removed along the entire length of film 26 and could be removed in sections only, as desired. Further, portion 40 could be removed from one side only of permeable film 26, if desired, so as to provide one edge 42 positioned as desired between vacuum perimeter 30 and sealing perimeter 32 along only one side of permeable film 26.

In accordance with the present invention, product 18 is preferably a fresh red meat product and impermeable film 28 provides package P with a longer shelf-life so long as film 28 is in place. Once film 28 is peeled, atmospheric oxygen permeates permeable film 26 and oxygenates the fresh red meat product so as to provide it with an oxygenated red color or "bloom" for placement in a retail display case. The bright red "bloom" is desirable as the consumer associates this bright red color with freshness. Of course, numerous other fresh meat or perishable products that are interactive or reactive with atmospheric gases may be packaged in accordance with the method of the present invention if desired.

Support member 20 may be any suitable tray, sheet or other support structure for holding product 18 in accordance with the present invention. Suitable materials from which support member 20 can be formed include polyvinyl chloride, polyethylene terephthalate, polystyrene, high density polyethylene, polypropylene, pulp, etc. Support member 20 may be in foamed or non-foamed form as desired, and can be laminated or otherwise provided with a conforming impermeable film for inhibiting the flow of gases through the tray. Such impermeable film preferably allows less than or equal to about 50 cc of oxygen to pass per square meter of said material per 24 hour period at 1 atm. and at a temperature of 73° F. The impermeable film preferably has a sealant layer which can be sealed, e.g., by heat-sealing, to film 26. Alternatively, support member 20 may itself be formed from a substantially impermeable material. In a preferred embodiment, support member 20 is a foam tray, for example an expanded polystyrene tray, having a laminate comprising an impermeable (barrier) layer and sealant layer laminated thereto. More preferably, support member 20 is a tray having a bottom portion 44 (See FIG. 1), side walls 46 extending from bottom 44, and a flange 48 extending outwardly from side walls 46 for sealing of film 26 and film 28 (multiple-film lidding material 22).

Multiple-film lidding material 22 preferably includes at least two films, specifically permeable film 26 and impermeable film 28 as described above. Of course, other layers or films such as additional permeable film or films may be provided so as to provide any of numerous other characteristics to package P as desired.

In accordance with the present invention, permeable film 26 is preferably an oxygen permeable or non-barrier film which may be a thermo-formable or stretchable material such as, e.g., a stretch-oriented film. Permeable film 26 may be formed from any material having sufficient oxygen permeability (as described below), and which may be securely sealed and bonded to support member 20. Examples include such materials as, e.g., ethylene/vinyl acetate copolymer, ethylene/butyl acrylate copolymer, polyethylene homopolymer and copolymers such as ethylene/alpha-olefin copolymer, ionomer, and other materials which are heat sealable to film 28 and/or directly to support member 20. The ethylene/alpha-olefin copolymer may be either heterogeneous or homogeneous. That is, ethylene/alpha-olefins formed by conventional Zeigler-Natta catalysis are heterogeneous copolymers, whereas single-site catalyzed copolymers such as those formed via metallocene catalyst technology are homogeneous in nature, all of which are within the scope of the invention. Further, permeable film 26 may be a single or multi-layer film having other layers for other desired purposes such as, e.g., abuse-resistance, heat-sealability, optical properties, strength, improved oxygen-permeability, etc.

Permeable film 26 preferably admits at least about 1,000 cc of gas (oxygen) per square meter of the material per 24 hour period at 1 atm. and at a temperature of 73° F. More preferably, permeable film 26 admits at least 5,000, even more preferably at least 10,000, and most preferably at least 100,000 cc of oxygen per square meter of the material per 24 hour period at 1 atm. and at a temperature of 73° F. This oxygen permeability is desirable so that, when barrier film 28 is peeled, oxygen can quickly permeate film 26 and oxygenate the fresh red meat product to provide the desirable bright red "bloom" associated by the consumer with freshness.

In addition to or instead of being inherently permeable as described above, film 26 can be perforated with very small holes and/or can have one or more larger holes over which is applied a "patch" of a material which has a very high degree of permeability to the passage of oxygen (e.g., a microporous material such as spun-bonded polyolefin or polyester materials, e.g., Tyvek™ from DuPont). The number and/or size of such holes can be selected to achieve any desired level of oxygen permeability, preferably at least 100,000 cc of oxygen per square meter of the material per 24 hour period at 1 atm. and at a temperature of 73° F.

Impermeable film 28 may be any suitable co-extruded or laminate film which is substantially impermeable to oxygen so that a fresh red meat product contained in a vacuum or low oxygen atmosphere in package P possesses an enhanced shelf-life over a package without barrier film 28. Barrier film 28 may be formable or stretchable for application to product 18 over permeable film 26 and support member 20, and may likewise be a single or multi-layer film having other layers for other purposes as desired.

Impermeable film 28 is preferably substantially impermeable to gas, especially oxygen, and preferably allows less than or equal to about 50 cc of oxygen to pass per square meter per 24 hour period at 1 atm. and at a temperature of 73° F.

It is noted that, because film 28 is to be removed prior to display to the consumer, the appearance of barrier film 28 is not critical. Thus, film 28 could acceptably be wrinkled, opaque or translucent without adverse consumer impact. Film 28 is, however, preferably sufficiently translucent so as to allow the product 18 contained in package P to be identified.

Suitable materials from which impermeable film 28 may be formed include one or more layers of, e.g., ethylene/vinyl alcohol copolymer, vinylidene chloride copolymer, hydrolyzed ethyl/vinyl acetate, polyesters and copolyesters, polyamides and copolyamides, and other oxygen-barrier materials known in the art.

Film 28 is preferably peelable from film 26 after sealing to package P. In this regard, film 28 and film 26 preferably contain interface layers which can be peelably adhered to one another. Such interface layers may be formed from such materials as, e.g., ionomer, polybutene, polypropylene, low density polyethylene, ethylene/alpha-olefin copolymer (e.g., linear low density polyethylene), ethylene/vinyl acetate, and blends of the foregoing materials.

As set forth above, gas flush tube 17 may be used to flush vacuum chamber 12, space 34, and space 35 with a desired gas after evacuation of same. Examples of suitable gas include nitrogen, carbon dioxide, or other inert gasses.

Thus disclosed is a method of preparing a package P having product 18 enclosed between support member 20 and multiple-film lidding material 22 wherein evacuation and gas flushing of space 34 between films 26 and 28 of multiple-film lidding material 22 is provided, whereby films 26 and 28 of multiple-film lidding material 22 can advantageously be sealed to support member 20 around product 18 in a single sealing station.

Although the presently described embodiments include a multiple-film lidding material having film 26 and film 28, it should be apparent that the teachings of the present invention are readily applicable to any process wherein it is desirable to evacuate and/or flush the space between two films or layers during preparation of a package.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method of preparing a package having a product enclosed between a support member and a multiple-film lid, comprising the steps of:

providing a support member supporting a product;

providing a multiple-film lid and positioning said multiple-film lid over said product and said support member, said multiple-film lid having a first film for enclosing said product on said support member when sealed thereto and a second film over said first film, said first film and said second film defining a first space therebetween and said first film and said support member defining a second space therebetween;

providing means for evacuating said first and second spaces;

providing a fluid passage in at least one of said first film and said second film for fluid communication between said means for evacuating and said first space;

evacuating said first and second spaces with said evacuation means; and sealing said multiple-film lid to said support member.

2. A method according to claim 1, further comprising the step of introducing a gas into said second space after said evacuating step.

3. A method according to claim 2, further comprising the step of introducing a gas into said first space after said evacuating step.

4. A method according to claim 1, wherein said first film comprises a material which allows at least about 1,000 cc of oxygen to pass per square meter of said material per 24 hour period at 1 atm. and at a temperature of 73° F.

5. A method according to claim 1, wherein said second film comprises a material which allows less than or equal to about 50 cc of oxygen to pass per square meter of said material per 24 hour period at 1 atm. and at a temperature of 73° F.

6. A method according to claim 1, wherein said support member is a tray having a substantially conforming film attached thereto which allows less than or equal to about 50 cc of oxygen to pass per square meter of said material per 24 hour period at 1 atm. and at a temperature of 73° F.

7. A method of preparing a package having a product enclosed between a support member and a multiple-film lid, comprising the steps of:

providing a support member supporting a product;

providing a multiple-film lid and positioning said multiple-film lid over said product and said support member, said multiple-film lid having a first film for enclosing said product on said support member and a second film over said first film, said first film and said second film defining a first space therebetween and said first film and said support member defining a second space therebetween;

providing a fluid passage in at least one of said first film and said second film;

providing an evacuating and sealing station having a vacuum means for providing a vacuum within said station and having a sealing means for sealing said multiple-film lid to said support member, said sealing means being positioned within said vacuum means, wherein said vacuum means defines a vacuum perimeter and said sealing means defines a sealing perimeter within said vacuum perimeter;

placing said support member supporting the product with said first and second films positioned thereover in said station such that said fluid passage is positioned inside said vacuum perimeter and outside said sealing perimeter;

evacuating said first and second spaces with said vacuum means; and sealing said multiple-film lid to said support member.

8. A method according to claim 7, wherein said step of providing said fluid passage comprises the step of providing said fluid passage in said first film.

9. A method according to claim 7, wherein said first film comprises a material which allows at least about 1,000 cc of oxygen to pass per square meter of said material per 24 hour period at 1 atm. and at a temperature of 73° F.

10. A method according to claim 7, wherein said second film comprises a material which allows less than or equal to about 50 cc of oxygen to pass per square meter of said material per 24 hour period at 1 atm. and at a temperature of 73° F.

11. A method according to claim 7, wherein said support member is a tray having a substantially conforming film attached thereto which allows less than or equal to about 50 cc of oxygen to pass per square meter of said material per 24 hour period at 1 atm. and at a temperature of 73° F.

12. A method according to claim 7, wherein said product is a fresh red meat product.

13. A method according to claim 7, wherein said step of providing said fluid passage comprises the step of providing at least one slit in said first film and positioning said at least one slit inside said vacuum perimeter and outside said sealing perimeter.

14. A method according to claim 13, wherein said step of providing said at least one slit comprises the steps of providing a plurality of slits in said first film and spacing said plurality of slits so as to provide spacings between slits of said plurality of slits.

15. A method according to claim 7, wherein said step of providing said fluid passage comprises the step of cutting said first film so as to provide at least a portion of at least one edge of said first film which is positioned between said vacuum perimeter and said sealing perimeter, thereby forming a fluid passage between said vacuum perimeter and said at least one edge of said first film.

16. A method according to claim 7, further comprising the step of introducing a gas into said second space after said evacuating step.

17. A method according to claim 16, further comprising the step of introducing a gas into said first space after said evacuating step.

18. A method according to claim 7, wherein said step of providing a support member comprises the step of providing a tray having a bottom portion, side walls extending from said bottom portion, and a flange portion outwardly extending from said side walls, and wherein said sealing step comprises the step of sealing said multiple-film lid to said flange.

19. A method according to claim 18, wherein said sealing step comprises the step of sealing said multiple-film lid to said flange whereby said first film is sealed to said flange, and said second film is sealed to said first film.

* * * * *